United States Patent [19]

Takeshi et al.

[11] 4,140,449

[45] Feb. 20, 1979

[54] PRESS FOR POWDER METALLURGY

[75] Inventors: Katagiri Takeshi; Ozu Masaaki, both of Tokyo, Japan

[73] Assignee: Yoshizuka Seiki Co., Ltd., Japan

[21] Appl. No.: 834,132

[22] Filed: Sep. 16, 1977

[30] Foreign Application Priority Data

Sep. 17, 1976 [JP] Japan ..... 51-110853

[51] Int. Cl.[2] ..... B22F 3/02; B30B 11/00

[52] U.S. Cl. ..... 425/78; 425/188; 425/193

[58] Field of Search ..... 425/78, 188, 193

[56] References Cited

U.S. PATENT DOCUMENTS 3,981,671 9/1976 Edwards ..... 425/188 X

*Primary Examiner*—J. Howard Flint, Jr.

*Attorney, Agent, or Firm*—Holman & Stern

[57] ABSTRACT

Improvement of a press for powder metallurgy having one or more rotatably arms mounting horizontally and respectively on an axis which is set up vertically at suitable portion of front and or rear walls of housing of the press. The arm has a box for supporting a die set and a metal mold on an end. The die set and the metal mold being supported in the box are easily transferred to a receiving portion thereof of an entrance of the press by rotation of the arm to horizontal direction, and the transferred die set and the metal mold are installed in accurate portion of the press by hand or a driven power means.

9 Claims, 5 Drawing Figures

PRESS FOR POWDER METALLURGY

BACKGROUND OF THE INVENTION

This invention relates to an improvement of a press for powder metallurgy and more particularly to a press having one or more rotatable arms which are horizontally and respectively mounted on an axis which is provided vertically at suitable portion of front and rear walls of the housing of the press, wherein a box is fitted on an end of an arm on the axis for support of a die set and a metal mold.

It has been realized in recent years that the reduction of hours for exchange of the die set and the metal mold is very important for a good way to lengthen working operation time of the press in order to accomplish increase of operation rate of powder molding work.

The die set and the metal mold are inevitably enlarged and become complicated in accordance with the tendency of new products being larger and more intricate. In the conventional way for setting up a die set, the die set is transferred by a forklift or other large vehicle in a factory. Such vehicle has a limited capacity of endurance, and such transfer by the forklift in the factory can be very dangerous, thus making the operation of set up and take off of the die set on the press dangerous.

With respect of use of the larger type of a metal mold, the metal mold is exchanged on the die set as it stands on the press. However, this way takes much time for replacement of a next metal mold, and moreover, when a crane or transfer machine is used for replacement of such metal mold, such crane, etc. is apt to strike or hit the press, thus easily damaging the press by the impact. Therefore, use of such crane or the like is very troublesome in fact.

With respect of use of a small type of die set and a metal mold, these are exchanged by means of chain block or by hand. In this way, the die set and the metal mold are apt to be accidentally dropped during transfer working which is very dangerous. For settlement of the above defects in the conventional press, it was previously disclosed as to ways and means that a truck and railway or track system was provided beside the press in order to transfer and set up a die set and a metal mold to the press from many course, but this way does not increase efficiency of replacement of the die set and the metal mold.

SUMMARY OF THE INVENTION

The present invention provides a new, safe and more efficient means which simplifies the replacement operation for a die set and a metal mold than a conventional means. The present invention improves upon the conventional press by providing one or plural rotatable arms which are horizontally and respectively mounted on an axis which is vertically set up at suitable portion of front or rear walls of housing of the press, with a box for support of a die set being fixed at an end of the arm.

In a case where an arm having the box is provided on the large type press, the die set is set up in the box at out place away from the press, and then a metal mold is fixed on the die set. This prepared die set with mounted metal mold is transferred to a predetermined receiving portion at an entrance of the press by rotation of the arm to the press direction. The die set with the metal mold is then positioned in the press by a suitable driven power means, i.e. a hydraulic machine or the like, or by hand.

When the die set and the metal mold are to be taken off from the press after molding, conversely the die set is turned to the box which is fixed at the arm, and then the arm is rotated to a standstill position away from the press. Thereafter the die set and the metal mold are exchanged with another set at the standstill position of distant place away from the press.

By this way of the present invention, the problems of endurance capacity on a transfer means and of danger through operation of exchange the metal mold are completely resolved.

Moreover, in a case where two sets of arm means are prepared on one press, another die set and a metal mold are beforehand set on another box fixed on another arm which is out of operation away from the press. When a formerly worked arm is turned to a standstill position away from the press, said beforehand prepared arm means can be immediately rotated to the press and the prepared die set and metal mold can be accordingly engaged with the press.

In a case where it is necessary to exchange a die set and a metal mold on the press having two arm means which can be alternately used, the required time for exchange of the die set and the metal mold is substantially reduced, and efficiency of operation to mold product on the press and safety in working operation are increased.

By carrying out of the die set from the press by said arm means, enough and wide space for replacement operation of the die set and the metal mold can be secured at the surroundings of the die set, therefore such work can be proceeded easily. Therefore, it is not necessary to stop operating the press for long time, and it can be made great strides as to the working ratio. And when a large type of the metal mold shall be set up, a crane or other transfer machine can be used at the standstill position away from the press.

Accordingly, an object of the present invention is to provide a press which increases the working ratio of exchange of a die set and a metal mold of the press for powder metallurgy by means of pivotably mounted arm means to the suitable position on the wall of the press.

Another object of the present invention is to provide a press which secures safety in work operation with a reduction in the time of set up and exchange of the die set and the metal mold.

Other object of the present invention is to provide a press to which the die set and the metal mold can be easily engaged.

A further object of the present invention is to provide a press where the die set and the metal mold can be prepared on a box which is fixed to on an end of the arm extending from the press.

Other object and many of the attendant advantages of this invention will be readily appreciated as the same becomes better understood by reference to the following description.

BRIEF DESCRIPTION OF THE DRAWINGS

The accompanying drawings illustrated the preferred embodiments of the present invention. In the drawings, the same reference numerals illustrated the same parts of the invention, in which.

THE DETAILED DESCRIPTION OF THE INVENTION

Figure 1:
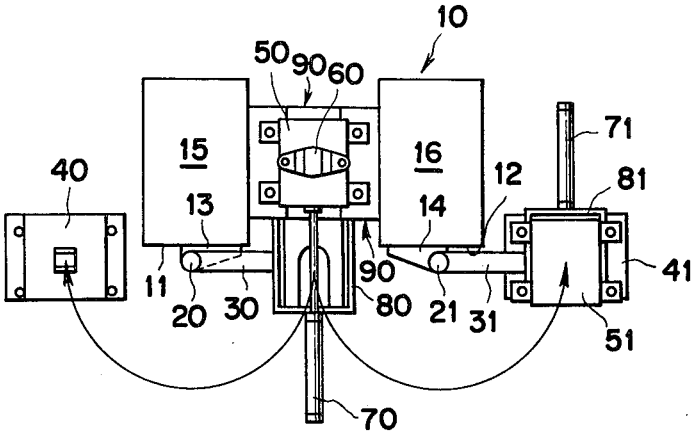
FIG. 1 is a diagrammatic theoretical explanation top plane view of a press having separately two sets of an arm and box means at front walls of the press.

Referring to the drawings, there is shown according to some preferred embodiments of the invention, as shown in FIG. 1, a press 10 for powder metallurgy has each flange 13, 14 on both front walls 11, 12 of the both side apparatus 15, 16, other flanges are not shown in the drawings, but these are prepared at rear walls and at lower portion of the both apparatus 15, 16. Axes 20, 21 are respectively and vertically engaged with the flanges. Rotatable arms 30, 31 are respectively and horizontally connected with the vertical axes 20, 21 so as to rotate on the each axis, and each box 80, 81 is respectively mounted on each end of the arms 30, 31 and die sets 50, 51 are respectively mounted on said box. If necessary, hydraulic cylinders 70, 71 can be preferrably and respectively equipped on said boxes 80, 81.

At both standstill positions away from the press on the orbit locus (shown by curved arrow) of the arms, simulators 40, 41 can be preferably and respectively established so as to engage the corresponding each box 80, 81, however, the simulator is not required to established.

A metal mold 60 is mounted on the die set 50 which is now engaged in the press 10 as shown in FIG. 1. Another metal mold shall be mounted on another die set 51 during molding operation by the metal mold 60. In a case where these simulators 40, 41 are established, the metal mold and or the die set mounted on the box at the end of the arm are engaged with the one of the simulator 40, 41, and then in accordance with operation of the simulator, a condition of the fixation between the die set and the metal mold is checked and examined so as to confirm the good condition of such fixation. Thereafter, the arm is horizontally rotated about 180 degrees to the empty press and is stopped at the entrance to the press, then the die set and the metal mold are inserted by hand or a driven power means i.e. a hydraulic machine or an electric motor, etc. When the empty box 81 at the end of the arm 31 prevents the press working under safe condition, said arm 31 is properly and conversely rotated to the standstill position.

When one of both arm means is presently worked, another empty box on the arm shall be prepared and fixed other die set and a metal mold, and then the die set setting the metal mold is examined and checked by another simulator. By this examination on the simulator, any trouble and mistake of molding through the actual press operation can be held in check and is kept away. Therefore, it can be sharply reduced much time and labor for exchange of the employed die set and the metal mold with the next new die set and the metal mold in accordance with use of the arm means on the press.

With respect to the means for rotation of said arm means, these arm means can be rotated by hand or a conventional driven power means which is not shown in the drawings. Any type of the driven power means shall be used so as to drive the arm means in accordance with predetermined data.

Figure 2:
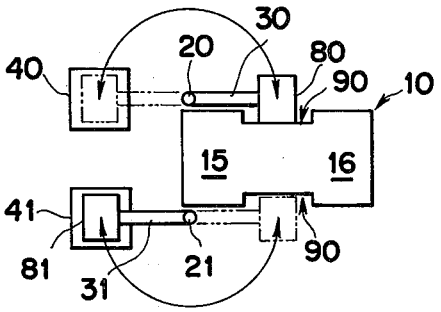
FIG. 2 is a diagrammatic theoretical explanation top plane view of a press having separately two sets of an arm and box at front and rear walls of one side apparatus of the press.
Figure 3:
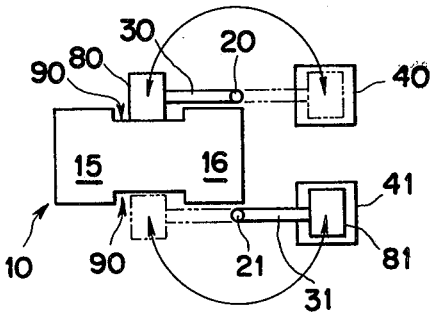
FIG. 3 is a diagrammatic theoretical explanation top plane view of a press having separately two sets of an arm and box means at front and rear walls of another side apparatus of the press.
Figure 4:
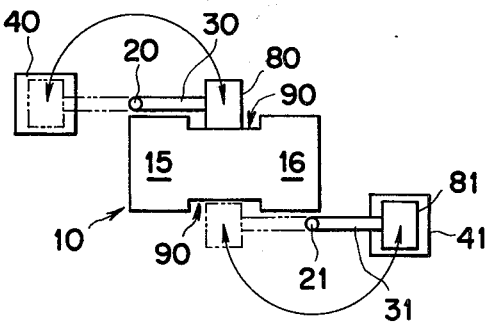
FIG. 4 is a diagrammatic theoretical explanation top plane view of a press having separately two sets of an arm and box means at rear wall of the left side apparatus and at front wall of the right side apparatus of the press.
Figure 5:
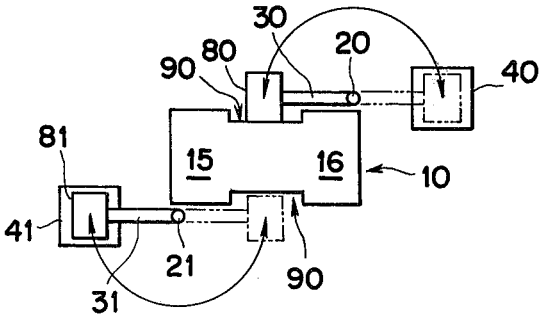
FIG. 5 is a diagrammatic theoretical explanation top plane view of a press having separately two sets of an arm and box means at front wall of the left side apparatus and at rear wall of the right side apparatus of the press.

The present invention is not limited to the above disclosed embodiment shown in FIG. 1. Position for setting up said arm means shall be suitably selected so as to apply said means to the most convenient wall of the press based on the molding operation and exchange working operation in accordance with the disposition of the press in the factory. Namely, the arm means can be properly arranged on the suitable wall of the press in accordance with the circumstances of the place or convenience of the working operation in the factory. For example, two sets of the arm means can be arranged on the rear wall of the press in contrast with the embodiment shown in FIG. 1. Moreover, the arm means can be properly arranged as shown in FIG. 2 to FIG. 5. In FIG. 2, an embodiment of the present invention is shown, in which two sets of the arm means are respectively arranged at front and rear walls of one side apparatus of the press. In FIG. 3, other embodiment of the present invention is shown, in which two sets of arm means are respectively arranged at front and rear walls of another side apparatus in contrast with the embodiment shown in FIG. 2. In FIG. 4, further embodiment of the present invention is shown, in which two sets of arm means are respectively arranged at rear wall of the left side apparatus and at front wall of the right side apparatus of the press. In FIG. 5, another embodiment of the present invention is shown, in which two sets of arm are respectively arranged at front wall of the left side apparatus and at rear wall of the right side apparatus in contrast with the embodiment shown in FIG. 4.

The above disclosed embodiments are respectively prepared two sets of the arm means an suitable position on the press, however, it can be properly adopted only one arm means on the suitable wall of the press.

Accordingly to the present invention, the die set and the metal mold is very easily exchanged. And it can be exchanged the other die set and the metal mold, and it can be checked the condition of fixation on the standstill position when two sets of the arm means are arranged, even though one arm means is operating to the press.

In a case where fixation of the next die set and the metal mold can be properly prepared on the one of plural arm means at the standstill position by arrangement of plural sets of the arm means, it is very efficient, safe and economical to exchange such die set and the metal mold by reduction of the time for replace of them without necessity of special space for exchange thereof in the factory though these space and time are required in the conventional way.

As above described, since set up of the die set depends on a cassette system by the supporting box on the arm means, any accessories or appendages can be adjusted and assembled taking enough time away from the press.

Even if the die set or the metal mold is damaged in the press during molding operation, such damaged device can be easily replaced and exchanged with another device at once by using of another set of the die set and the metal mold on the arm means, therefore, the press is not stopped so long time for exchange of the new device.

The invention may be embodied on other specific forms without departing from its spirit or essential characteristics. The described embodiment is to the considered in all respect only as illustrated and not respective and the scope of the invention is, therefore, indicated by the appendant claims rather than by the foregoing description. All changes which come within the meaning and range of equivalency of the claims are to be amended within their scope. Consequently, it is recognized many variation may be made without departing from the scope or spirit of the present invention.

What is claimed is:

1. An improved press for powder metallurgy having sides; two side apparatuses, one on each side, each side apparatus having a front wall and a rear wall, each wall having a flange extending therefrom; at least one entrance; and an arm means, arm means comprising:

at least one vertical axes mounted on the flange of one of the walls of one of the side apparatuses, arm pivotably and horizontally connected to each said axis and being of a length so as to place the free end of said arm at at least one entrance of the press when rotated and at a standstill position away from the press, and a box mounted on the free end of said arm carrying a die set and a metal mold, said die set and said metal mold being placed before the entrance of the press when operated.

2. The improved press for powder metallurgy as in claim 1 wherein two sets of the arm means are respectively installed on the front walls of both side apparatuses of the press.

3. The improved press for powder metallurgy as in claim 1 wherein two sets of the arm means are respectively installed on the rear walls of both side apparatuses of the press.

4. The improved press for powder metallurgy as in claim 1 wherein two sets of the arm means are respectively installed on front and rear walls of one side apparatus of the press.

5. The improved press for powder metallurgy as in claim 1 wherein two sets of the arm means are respectively and diagonally installed on front and rear walls of both apparatus of the press.

6. The improved press for powder metallurgy as in claim 1 wherein one set of the arm means is installed on a wall of both side apparatuses of the press.

7. The improved press for powder metallurgy as in claim 1 wherein the supporting box has a driven power means for setting up the die set in the press.

8. The improved press for powder metallurgy as in claim 1 further comprising a press simulator means established at the standstill position of the supporting box away from the press for simulating the press to allow adjustments to be made to said die set and said metal mold.

9. The improved press for powder metallurgy as in claim 1 wherein said arm means further has a driven power means for horizontal rotation of the arm.

* * * * *